US008735700B2

(12) United States Patent
Abe

(10) Patent No.: US 8,735,700 B2
(45) Date of Patent: May 27, 2014

(54) BEARING MEMBER

(71) Applicant: Kabushiki Kaisha Kawai Gakki Seisakusho, Hamamatsu (JP)

(72) Inventor: Kiyoshi Abe, Hamamatsu (JP)

(73) Assignee: Kabushiki Kaisha Kawai Gakki Seisakusho, Hamamatsu-shi, Shizuoka-ken (JP)

( * ) Notice: Subject to any disclaimer, the term of this patent is extended or adjusted under 35 U.S.C. 154(b) by 49 days.

(21) Appl. No.: 13/628,249

(22) Filed: Sep. 27, 2012

(65) Prior Publication Data

US 2014/0083274 A1 Mar. 27, 2014

(30) Foreign Application Priority Data

Sep. 30, 2011 (JP) ..... 2011-217617

(51) Int. Cl.
*G10C 3/18* (2006.01)

(52) U.S. Cl.
USPC ..... 84/243

(58) Field of Classification Search
USPC ..... 84/173, 174, 237, 243, 423 R, 438
See application file for complete search history.

(56) References Cited

U.S. PATENT DOCUMENTS 4,673,515 A 6/1987 Sakai
5,299,484 A * 4/1994 Ishida et al. ..... 84/251

FOREIGN PATENT DOCUMENTS

JP 61-60295 U 4/1986
JP 63-1347 Y2 1/1988
JP 9-258720 A 10/1997
JP 2010-181542 A 8/2010

* cited by examiner

*Primary Examiner* — Kimberly Lockett
(74) *Attorney, Agent, or Firm* — Davis & Bujold, PLLC; Michael J. Bujold

(57) ABSTRACT

A bearing member is to be used for an action mechanism in a keyboard instrument, the action mechanism provided with an action member that pivots in accordance with a key-depressing operation, and the bearing member includes: an inner layer having a through hole through which a shaft provided in the action member is inserted; and an outer layer formed in an outer side of the inner layer. The inner layer is formed of a first material having a higher stability against humidity than a stability against humidity of the outer layer. The outer layer is formed of a second material having a resilience greater than a resilience of the inner layer.

5 Claims, 4 Drawing Sheets

BEARING MEMBER

CROSS-REFERENCE TO RELATED APPLICATIONS

This application claims the benefit of Japanese Patent Application No. 2011-217617 filed Sep. 30, 2011 in the Japan Patent Office, the disclosure of which is incorporated herein by reference.

BACKGROUND

The present invention relates to a bearing member in a keyboard instrument provided with an action mechanism which includes a plurality of action members pivoting in accordance with key-depressing operations and a supporting member pivotally supporting the action members, the bearing member supporting the action members in a rotatable manner.

Conventionally, an action mechanism in a keyboard instrument is configured such that a plurality of action members are supported, respectively, by supporting members in a pivotable manner about the supporting members; for example, a jack is supported by a wippen in a pivotable manner about the wippen.

For example, a shaft is fixed to an action member, and a bearing hole is formed in a supporting member; a bearing member (bushing) provided with a through hole into which the shaft is to be inserted is attached to the bearing hole; by this configuration, as a result of inserting the shaft into the through hole of the bearing member, the action member pivots about the shaft as a fulcrum, with respect to the supporting member.

Generally, as a material of this bearing member, woven felt made of wool (commonly referred to as "cloth") is used.

However, since cloth tends to swell due to humidity, it is concerned that ease of pivoting (in other words, difficulty of pivoting) of the action member may change depending on humidity in a surrounding atmosphere where the keyboard instrument is installed.

Therefore, it has been considered to use Teflon felt (Teflon: registered trademark) which hardly swells due to humidity (i.e., which has a higher stability against humidity), compared with cloth.

SUMMARY

To the bearing member, impacts are repeatedly applied from the shaft in radial directions (i.e., directions perpendicular to the shaft). Therefore, if Teflon felt (Teflon: registered trademark) having a low resilience compared with cloth is used as the bearing member, the through hole may be deformed, resulting in so-called "rattling".

As above, it is desired to provide a bearing member by which ease of pivoting (in other words, difficulty of pivoting) of the action member hardly changes due to humidity and with which "rattling" hardly occurs.

The present invention provides a bearing member to be used for an action mechanism in a keyboard instrument. The action mechanism includes an action member that pivots in accordance with a key-depressing operation. The bearing member includes an inner layer having a through hole through which a shaft provided in the action member is inserted, and an outer layer formed in an outer side of the inner layer. The inner layer is formed of a first material having a higher stability against humidity than a stability against humidity of the outer layer. The outer layer is formed of a second material having a resilience greater than a resilience of the inner layer.

In the bearing member constituted as above, the inner layer having the through hole is formed of the first material having a higher stability against humidity than a stability against humidity of the outer layer. Therefore, even if humidity in a surrounding atmosphere where the keyboard instrument is installed changes, the through hole can be inhibited from narrowing because of swelling of the first material due to humidity. Thus, when the bearing member of the present invention is used, ease of pivoting (in other words, difficulty of pivoting) of the action member hardly changes.

Moreover, in the present invention, since the outer layer is formed of the second material having a resilience greater than a resilience of the inner layer, even if impacts are applied to the shaft, the impacts are absorbed by the outer layer. Therefore, deformation of the inner layer can be inhibited. As above, when the bearing member configured as above is used, it is possible to inhibit deformation of the through hole, thereby inhibiting so-called "rattling".

Here, the first material may be preferably Teflon felt (Teflon: registered trademark). Teflon felt (Teflon: registered trademark) has a higher stability against humidity as well as an excellent resistance to friction (friction resistance), compared with cloth. Thus, Teflon felt (Teflon: registered trademark) is suitable as a material for the inner layer.

Moreover, the second material may be preferably meta-aramid fiber. Meta-aramid fiber has a greater resilience compared with the cloth; therefore, meta-aramid fiber is suitable as a material for the outer layer.

Needless to say, the first material should not be limited to Teflon felt (Teflon: registered trademark), and the second material should not be limited to meta-aramid fiber.

BRIEF DESCRIPTION OF THE DRAWINGS

The invention will now be described below, by way of example, with reference to the accompanying drawings, in which.

DETAILED DESCRIPTION OF THE PREFERRED EMBODIMENTS

The present invention should not be limited to the embodiments explained below. Rather, the present invention can be implemented in various manners without departing from the technical scope of the present invention.

In the following explanation, a term "left-to-right direction" indicates a left-to-right direction viewed from a player who plays a grand piano (not shown) (i.e., a direction perpendicular to the plane of FIG. 1); a term "front-to-rear direction" indicates a front-to-rear direction viewed from the player (i.e., a left-to-right direction in the plane of FIG. 1; this direction is indicated by a double-headed arrow A in FIG. 1); and a term "up-and-down direction" indicates an up-and-down direction viewed from the player (i.e., an up-and-down direction in the plane of FIG. 1; this direction is indicated by a double-headed arrow B in FIG. 1).

A grand piano has a keyboard (not shown) comprised of a large number of keys 1 (see FIG. 1) arranged in the left-to-right direction viewed from the player.

As is well known, each of the keys 1 has an elongated shape. Although it is not shown, the key 1 is supported by a balance pin in a pivotable manner about the balance pin; the balance pin is provided in a standing manner on a keyframe above a key bed at substantially a center in a longitudinal direction of the key 1.

Figure 1:
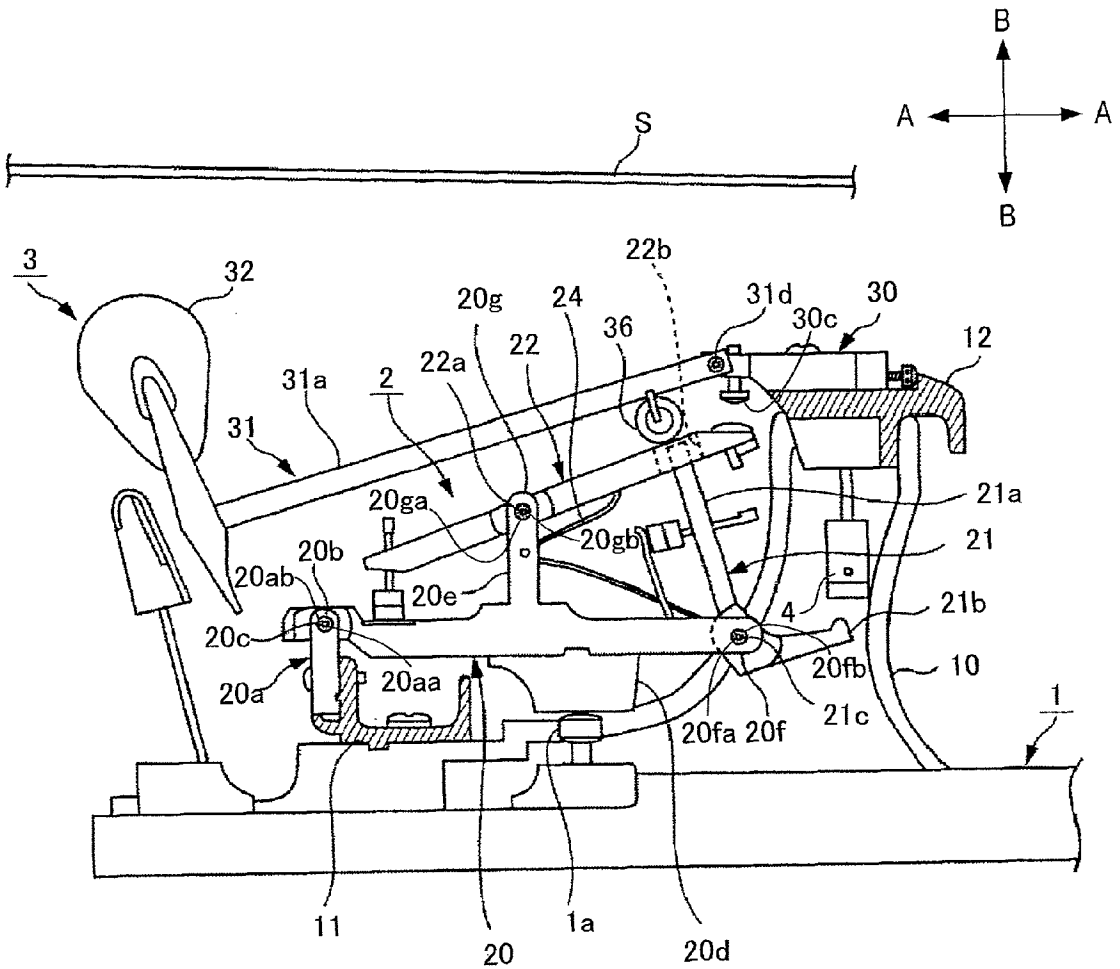
FIG. 1 is a schematic view of an action mechanism and a hammer which are provided in a grand piano according to the present embodiment.

As shown in FIG. 1, an action mechanism 2 is disposed above the key 1 and at the front side of a center of pivoting of the key 1. Moreover, above the action mechanism 2, a hammer 3 is disposed. Furthermore, a string S is stretched out above the hammer 3.

[Action Mechanism 2]

The action mechanism 2 includes a wippen 20, a jack 21, and a repetition lever 22.

The wippen 20 is disposed such that a longitudinal direction thereof substantially coincides with the front-to-rear direction. An end at the front side of the wippen 20 (hereinafter, "front end" of the wippen 20) is pivotally supported by a wippen flange 20*a*.

The wippen flange 20*a* is disposed such that a longitudinal direction thereof substantially coincides with the up-and-down direction and is screwed onto a wippen rail 11. The wippen rail 11 is extended over a plurality of brackets 10 (only one of which is shown in FIG. 1) arranged spaced apart from one another in the left-to-right direction.

The wippen flange 20*a* has a bifurcated upper end including two arm parts 20*b*. For details of shapes of the arm parts 20*b* (i.e., shape of the bifurcated upper end), reference should be made to arm parts 31*c* (which will be explained later) in FIGS. 2 and 3. The arm part 20*b* has the same shape as that of the arm part 31*c*. In each of the two arm parts 20*b*, a pin hole 20*aa* is formed. In FIG. 1, only one of the two arm parts 20*b* can be seen.

The front end of the wippen 20 is inserted between the two arm parts 20*b*, and a center pin 20*c* is horizontally inserted through the front end of the wippen 20 and the two arm parts 20*b* along the left-to-right direction. By this configuration, the wippen 20 is supported by the wippen flange 20*a* via the center pin 20*c* in a pivotable manner about the center pin 20*c* with respect to the wippen flange 20*a*.

In this case, the center pin 20*c* is rotatable with respect to the arm parts 20*b*, while being secured to the wippen 20. Specifically, to the pin hole 20*aa* of each of the arm parts 20*b*, a bearing member 20*ab* having a cylindrical shape can be attached (i.e., can be secured). A configuration of the bearing member 20*ab* will be explained later. The center pin 20*c* is inserted through the bearing members 20*ab* in a rotatable manner with respect to the bearing members 20*ab*. Thereby, the center pin 20*c* can be rotated with respect to the pin holes 20*aa* (and the arm parts 20*b*) via the bearing members 20*ab*.

Moreover, the wippen 20 is provided with a heel 20*d* protruding downward at a substantially central part of the wippen 20 in the front-to-rear direction. The wippen 20 is disposed on the key 1, via the heel 20*d* and a capstan screw 1*a* provided at a rear part of the key 1.

Furthermore, the jack 21 is connected to a rear end of the wippen 20.

The jack 21 includes a hammer push-up portion 21*a* and a regulating button abutment portion 21*b* (hereinafter, referred to as abutment portion 21*b*). The hammer push-up portion 21*a* extends obliquely upward in the up-and-down direction. The abutment portion 21*b* extends rearward at substantially right angle from a lower end part of the hammer push-up portion 21*a*. Thereby, the jack 21 has an L-shape when viewed from a side thereof.

The rear end of the wippen 20 is formed to be a bifurcated shape and this bifurcated rear end includes two arm parts 20*f*. In each of the two arm parts 20*f*, a pin hole 20*fa* is formed. In FIG. 1, only one of the two arm parts 20*f* can be seen.

Between the two arm parts 20*f*, a corner part of the jack 21 (i.e., a connecting section which connects the hammer push-up portion 21*a* and the abutment portion 21*b*) is disposed. A center pin 21*c* is horizontally inserted through the two arm parts 20*f* and the corner part of the jack 21 along the left-to-right direction. By this configuration, the jack 21 is supported by the rear end of the wippen 20 via the center pin 21*c* in a pivotable manner about the center pin 21*c*.

In this case, the center pin 21*c* is roratable with respect to the arm parts 20*f*, while being secured to the jack 21. Specifically, to the pin hole 20*fa* of each of the arm parts 20*f*, a bearing member 20*fb* having a cylindrical shape can be attached (i.e., can be secured). A configuration of the bearing member 20*fb* will be explained later. The center pin 21*c* is inserted through the bearing members 20*fb* in a rotatable manner with respect to the bearing members 20*fb*. Thereby, the center pin 21*c* can be rotated with respect to the pin holes 20*fa* (and the arm parts 20*f*) via the bearing members 20*fb*.

Moreover, an upper end part of the hammer push-up portion 21*a* is inserted into a jack guide hole 22*b* (which will be explained later) of the repetition lever 22. The upper end part of the hammer push-up portion 21*a* is disposed facing and at a slight distance apart from a shank roller 36 (which will be explained later) placed on the repetition lever 22.

Furthermore, the jack 21 is biased by a repetition spring 24 (which will be explained later) in a returning direction (counter-clockwise direction in FIG. 1).

The repetition lever 22 extends obliquely-upward to the rear in the front-to-rear direction. The repetition lever 22 is supported by a lever flange portion 20*e* projecting upward from a substantially central area of the wippen 20 in the front-to-rear direction.

The lever flange portion 20*e* has a bifurcated upper end including two arm parts 20*g*. In each of the two arm parts 20*g*, a pin hole 20*ga* is formed. In FIG. 1, only one of the two arm parts 20*g* can be seen.

Between the two arm parts 20*g*, a substantially central part of the repetition lever 22 is disposed. A center pin 22*a* is horizontally inserted through the two arm parts 20*g* and the repetition lever 22 along the left-to-right direction.

Thereby, the repetition lever 22 is supported by the upper end of the lever flange portion 20*e* via the center pin 22*a* in a pivotable manner about the center pin 22*a*.

In this case, the center pin 22*a* is rotatable with respect to the arm parts 20*g*, while being secured to the repetition lever 22. Specifically, to the pin hole 20*ga* of each of the arm parts 20*g*, a bearing member 20*gb* having a cylindrical shape can be attached (i.e., can be secured). A configuration of the bearing member 20*gb* will be explained later. The center pin 22*a* is inserted through the bearing members 20*gb* in a rotatable manner with respect to the bearing members 20*gb*. Thereby, the center pin 22*a* can be rotated with respect to the pin holes 20*ga* (and the arm parts 20*g*) via the bearing members 20*gb*.

Moreover, the repetition lever 22 is biased by the repetition spring 24 attached to the lever flange portion 20*e*, in a returning direction (counter-clockwise direction in FIG. 1).

Furthermore, the jack guide hole 22*b* penetrating the repetition lever 22 in the up-and-down direction is formed in a rear part thereof. On the repetition lever 22, the hammer 3 is disposed via the shank roller 36 which abuts on a vicinity of the jack guide hole 22*b* at an upper surface side of the repetition lever 22.

[Hammer 3]

The hammer 3 includes a shank flange 30, a hammer shank 31, and a hammer head 32.

The shank flange 30 is formed of synthetic resin. As shown in FIG. 1, the shank flange 30 is screwed onto an upper surface of a hammer shank rail 12 extending over the plurality of brackets 10.

Figure 2:
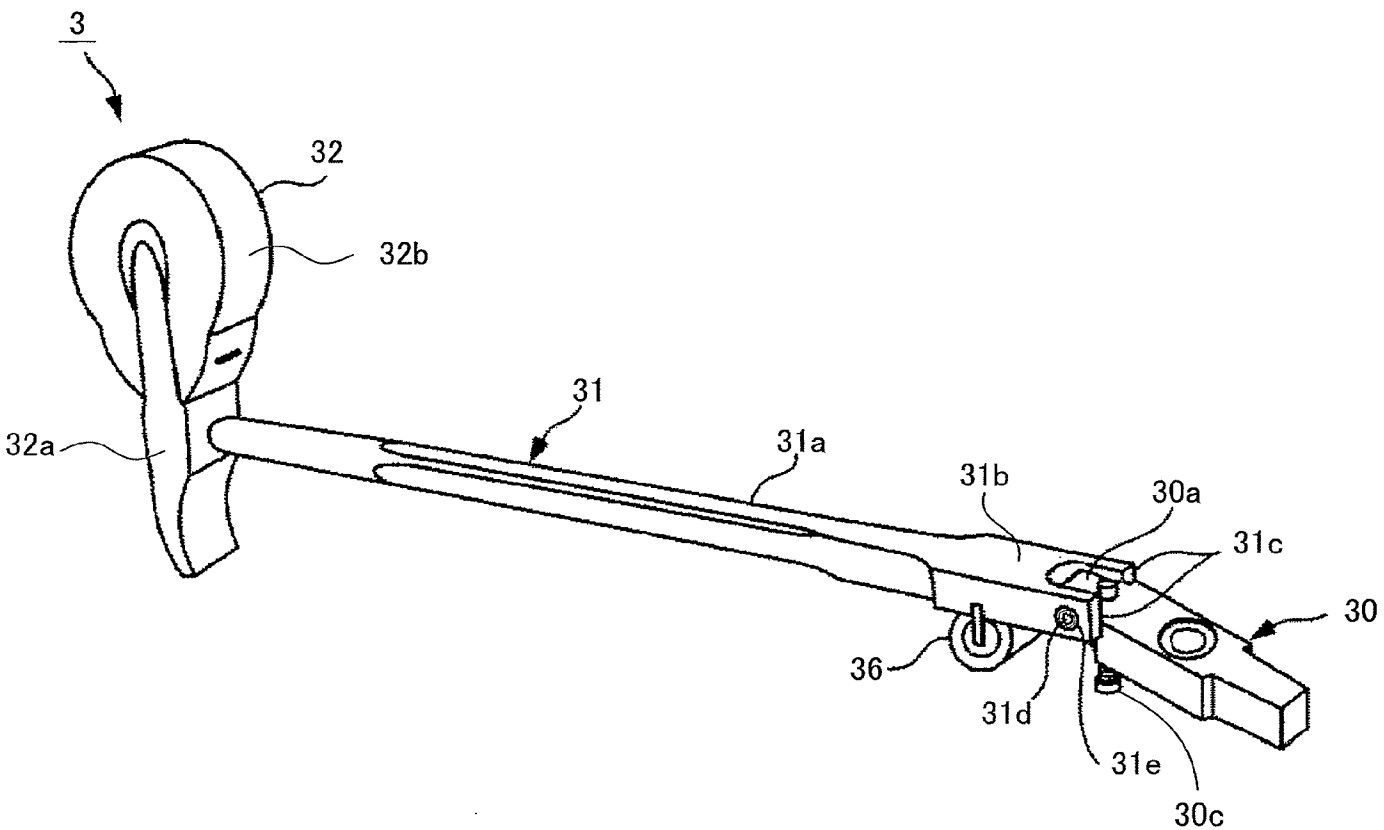
FIG. 2 is a perspective view of the hammer in the present embodiment.

As shown in FIG. 2, the shank flange 30 is formed to be a longitudinal shape and has a substantially rectangular shape in cross section taken along the left-to-right direction.

At a front end part of the shank flange 30, an arrangement part 30*a* is formed. The arrangement part 30*a* has a width slightly narrower in the left-to-right direction than a distance between the arm parts 31*c* (which will be explained later) of the hammer shank 31.

Figure 3:
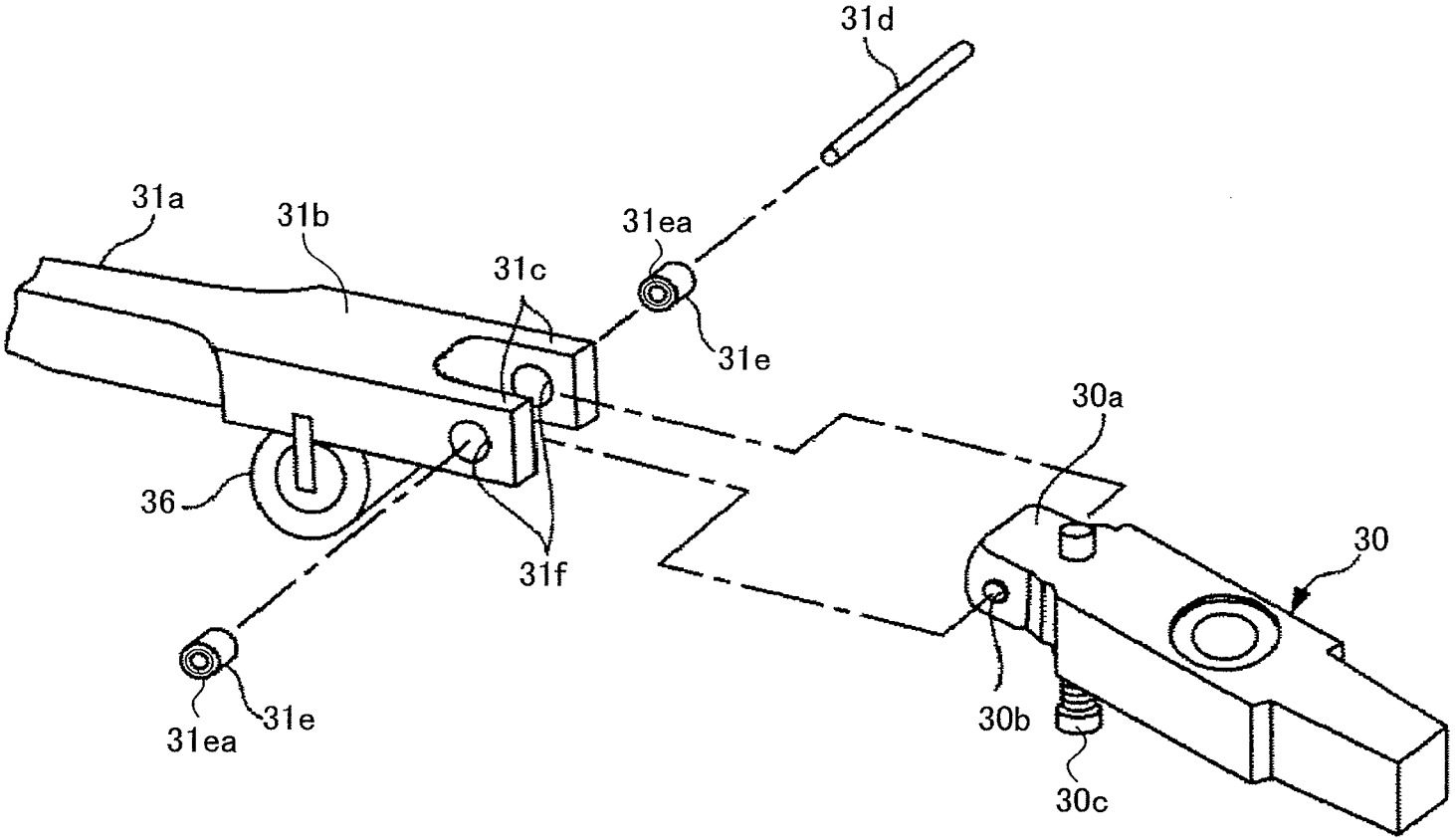
FIG. 3 is a perspective view illustrating how to pivotably attach a hammer shank to a shank flange in the present embodiment.

In the arrangement part 30*a*, as shown in FIG. 3, a pin attachment hole 30*b* penetrating the arrangement part 30*a* in the left-to-right direction is formed. Moreover, in an underside surface at the front side of the arrangement part 30*a*, a button 30*c* is provided.

As shown in FIG. 2, the hammer shank 31 is formed of elongated stick-like wood and has a rear end with a wider width in the left-to-right direction (i.e., width in an arrangement direction of the arm parts 31*c* which will be explained later), than a width of the other part of the hammer shank 31. Hereinafter, the part with the wider width in the rear end of the hammer shank 31 is referred to as "flange portion 31*b*", and the other part are referred to as "shank stick portion 31*a*".

The flange portion 31*b* has a bifurcated rear end to be attached to the shank flange 30. In FIG. 2, each part of the bifurcated rear end is indicated as the arm part 31*c*.

In each of the two arm parts 31*c*, a pin hole 31*f* penetrating the arm part 31*c* in the left-to-right direction is formed. A bearing member 31*e* having a cylindrical shape is attached to each of the pin holes 31*f*. Details of the bearing member 31*e* will be explained later.

Moreover, the shank roller 36 is attached to an underside surface, which is closer to the shank stick portion 31*a*, of the flange portion 31*b*.

As shown in FIG. 2, the hammer head 32 is fixedly attached to a front-side tip end of the shank stick portion 31*a*.

The hammer head 32 includes a hammer wood 32*a* and a hammer felt 32*b*. The hammer wood 32*a* has an elongated shape, and is directly attached to the shank stick portion 31*a* at a position perpendicular to the shank stick portion 31*a*.

The hammer felt 32*b* is attached to the hammer wood 32*a* at an upper side thereof.

The hammer 3 constituted as above is assembled in the following manner. Explanations will be given with reference to FIG. 3.

Firstly, the hammer shank 31 is disposed such that the arrangement part 30*a* of the shank flange 30 is located between the arm parts 31*c* of the hammer shank 31. A center pin 31*d* is inserted through a through hole 31*ec* of each of the bearing members 31*e*, and through the pin attachment holes 30*b*.

Consequently, the center pin 31*d* is secured to the pin attachment hole 30*b*, and both ends of the center pin 31*d* are supported by the respective pin holes 31*f* via the respective bearing members 31*e* in a rotatable manner.

Thereby, the hammer shank 31 is pivotally supported by the shank flange 30 via the center pin 31*d*.

As shown in FIG. 1, a regulating button 4 is attached under the hammer shank rail 12.

[Action]

In a grand piano provided with the action mechanism configured as above, when the key 1 is depressed, the wippen 20 is pushed up via the capstan screw 1*a*. Thereby, the wippen 20 pivots about the center pin 20*c* in the counter-clockwise direction, and the jack 21 and the repetition lever 22 pivot so as to push up the shank roller 36 via the repetition lever 22.

When the repetition lever 22 further pivots, a rear-side end of the repetition lever 22 hits against the button 30*c* to be pushed down. Thereby, the repetition lever 22 pivots about the center pin 22*a*. An upper end of the jack 21 abuts against the shank roller 36; as a result, the jack 21 further pushes up the shank roller 36.

When the abutment portion 21*b* of the jack 21 abuts against the regulating button 4 and the jack 21 pivots about the center pin 21*c*, the abutment between the upper end of the jack 21 and the shank roller 36 is released.

In this case, until the abutment between the jack 21 and the shank roller 36 is released, the hammer 3, which has gained force, continues further moving upward and strikes a string S made of piano wires, thereby generating a piano note.

[Bearing Member]

Hereinafter, the bearing members 20*ab*, 20*fb*, 20*gb*, and 31*e* of the present embodiment will be explained. Here, detailed explanations will be given with respect to the bearing member 31*e*. The bearing members 20*ab*, 20*fb*, and 20*gb* have the same configurations as that of the bearing member 31*e*. Therefore, detailed explanations with respect to the bearing members 20*ab*, 20*fb*, and 20*gb* will be omitted here.

Figure 4:
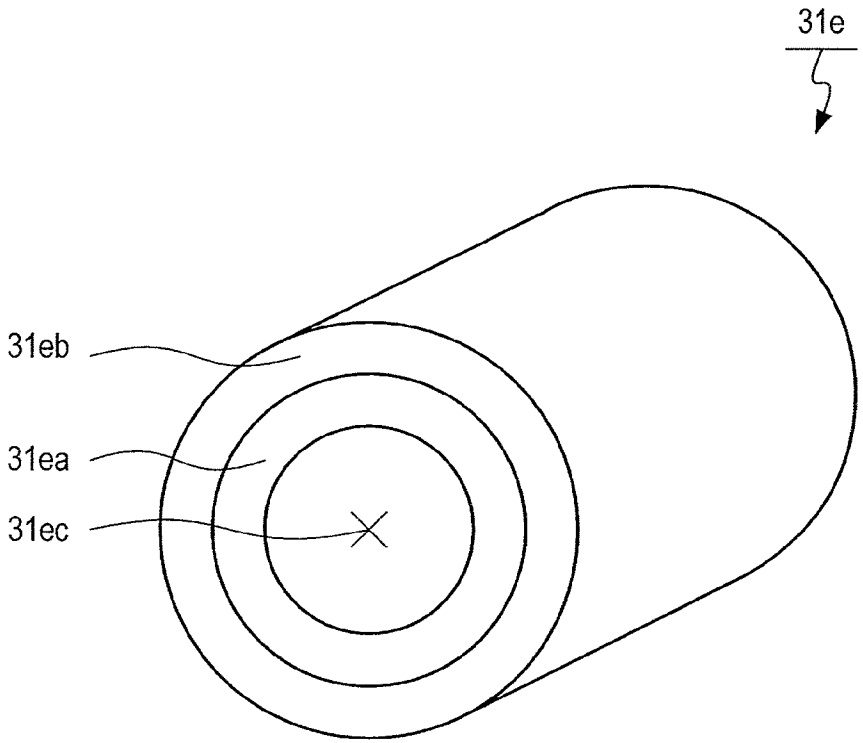
FIG. 4 is a perspective view of a bearing member.

As shown in FIG. 4, the bearing member 31*e* used in a keyboard instrument of the present embodiment has a double-layer configuration and includes an inner layer 31*ea* and an outer layer 31*eb*. The inner layer 31*ea* is formed in a tubular shape having the through hole 31*ec* into which the center pin 31*d* is inserted (see, FIG. 3). The outer layer 31*eb* is formed in a tubular shape and layered on an outer side of the inner layer 31*ea*.

The inner layer 31*ea* is made of Teflon felt (Teflon: registered trademark). The outer layer 31*eb* is made of meta-aramid fiber.

Teflon felt (Teflon: registered trademark) constituting the inner layer 31*ea* has following characteristics: compared with meta-aramid fiber constituting the outer layer 31*eb*, Teflon felt (Teflon: registered trademark) has an excellent resistance to friction (friction resistance); and Teflon felt (Teflon: registered trademark) hardly swells due to ambient humidity (in other words, has a higher stability against ambient humidity), compared with cloth and meta-aramid fiber.

Meta-aramid fiber constituting the outer layer 31*eb* has a greater resilience than Teflon felt (Teflon: registered trademark) constituting the inner layer 31*ea*.

The bearing member 31*e* constituted as above is manufactured in the following manner.

Firstly, Teflon felt (Teflon: registered trademark) and cloth made of meta-aramid fiber, each of which has been cut out into a flat plate-like shape, are layered together.

Next, a surface of the above layered body formed of the Teflon felt (Teflon: registered trademark) and the cloth made of meta-aramid fiber, is repeatedly punched by a needle (i.e., needle-punching is performed), thereby interweaving a fiber constituting the Teflon felt (Teflon: registered trademark) and the meta-aramid fiber. Consequently, the Teflon felt (Teflon: registered trademark) and the cloth made of meta-aramid fiber are joined together.

Then, the joined body formed of the Teflon felt (Teflon: registered trademark) and the cloth made of meta-aramid fiber, are rolled into a tubular shape. An adhesive is applied to an outer surface of this rolled body. One axial end of the rolled body is inserted into one opening of the pin hole 31*f* and then pulled out from the other opening of the pin hole 31*f*. A portion of the rolled body which is projecting from the pin hole 31*f* is cut off. Thereby, the bearing member 31*e* is attached to the pin hole 31*f*.

[Characteristic of Bearing Member Used in Grand Piano of the Present Embodiment]

Since the inner layer 31*ea* having the through hole 31*ec* is made of Teflon felt (Teflon: registered trademark) having a higher stability against humidity compared with the outer layer 31*eb*, the inner layer 31*ea* hardly swells due to humidity even if humidity in the surrounding atmosphere where the grand piano is installed changes. For this reason, if the above-constituted bearing member 31*e* is used, ease of pivoting (in other words, difficulty of pivoting) of the hammer shank 31 with respect to the shank flange 30 hardly changes.

Moreover, the outer layer 31*eb* is made of meta-aramid fiber having a greater resilience, compared with the inner layer 31*ea*. Therefore, even if impacts are applied to the center pin 31*d*, the impacts are easily absorbed by the outer layer 31*eb*. Thereby, deformation of the inner layer 31*ea* can be inhibited. Thus, use of the bearing member 31*e* makes it possible to suppress so-called "rattling".

[Explanation of Correspondence]

The center pins 31*d*, 20*c*, 21*c*, and 22*a* of the present embodiment correspond to one example of a shaft described in the claims. Moreover, a relationship between the hammer shank 31 and the shank flange 30, a relationship between the wippen flange 20*a* and the wippen 20, and a relationship between the wippen 20, and the jack 21 and the repetition lever 22 in the present embodiment, correspond to one example of a relationship between an action member and a supporting member described in the claims.

[Other Embodiment]

In the above-explained embodiment, the bearing members 20*ab*, 20*fb*, 20*gb*, and 31*e* are constituted of materials made by layering the Teflon felt (Teflon: registered trademark) onto the cloth made of meta-aramid fiber. However, instead of layering the Teflon felt (Teflon: registered trademark), the bearing members 20*ab*, 20*fb*, 20*gb*, and 31*e* may be formed in the following manner. That is, the outer layer 31*eb* may be formed of elastomer (such as natural rubber, synthetic rubber, silicon rubber, or the like), and the inner layer 31*ea* may be formed by implanting Teflon (registered trademark) in this outer layer 31*eb*.

Although the inner layer 31*ea* is formed of Teflon felt (Teflon: registered trademark) in the aforementioned embodiment, the inner layer 31*ea* may be formed of any materials having a sufficiently higher stability against humidity, compared with the outer layer 31*eb*.

Moreover, the outer layer 31*eb* is formed of the cloth made of meta-aramid fiber. However, the outer layer 31*eb* may be formed of any cloth made of fibers having a greater resilience (such as rayon fiber, polyester fiber, polyurethane fiber, acrylic fiber, and the like), compared with the inner layer 31*ea*.

What is claimed is:

1. A bearing member to be used for an action mechanism in a keyboard instrument, the action mechanism including an action member that pivots in accordance with a key-depressing operation, the bearing member comprising:

an inner layer having a through hole through which a shaft provided in the action member is inserted; and an outer layer formed in an outer side of the inner layer, the inner layer formed of a first material having a higher stability against humidity than a stability against humidity of the outer layer, and the outer layer formed of a second material having a resilience greater than a resilience of the inner layer.

2. The bearing member according to claim 1, wherein the first material is Teflon felt.

3. The bearing member according to claim 1, wherein the second material is meta-aramid fiber.

4. The bearing member according to claim 2, wherein the second material is meta-aramid fiber.

5. The bearing member according to claim 1, wherein the action mechanism includes a supporting member that supports the action member, and the bearing member is attached to a bearing hole provided in the supporting member.

* * * * *